US009922778B2

(12) United States Patent
Wu et al.

(10) Patent No.: US 9,922,778 B2
(45) Date of Patent: Mar. 20, 2018

(54) SWITCH WIRE CONNECTION DEVICE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Cherng Shin Wu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/295,023

(22) Filed: Oct. 17, 2016

(65) Prior Publication Data

US 2017/0110264 A1 Apr. 20, 2017

(30) Foreign Application Priority Data

Oct. 19, 2015 (TW) ..... 104216730 U
Oct. 20, 2015 (TW) ..... 104134449 A

(51) Int. Cl.
*H01H 13/14* (2006.01)
*H01H 1/58* (2006.01)
*H01H 13/04* (2006.01)
*H01H 13/50* (2006.01)

(52) U.S. Cl.
CPC ..... *H01H 1/58* (2013.01); *H01H 13/04* (2013.01); *H01H 13/50* (2013.01)

(58) Field of Classification Search
CPC ..... H01H 13/14; H01H 13/18; H01H 13/183; H01H 1/5844; H01R 13/701; H01R 4/4818; H01R 4/4845
USPC ..... 200/530, 532, 284; 439/816, 438
See application file for complete search history.

(56) References Cited

U.S. PATENT DOCUMENTS 4,806,711 A * 2/1989 Eckhaus ..... H01H 1/585 200/61.62
5,322,983 A * 6/1994 Tseng ..... H01H 15/06 200/547
7,625,253 B2 * 12/2009 Eppe ..... H01R 4/4836 439/835
9,466,911 B1 * 10/2016 Wu ..... H01R 4/4836
2017/0110267 A1 * 4/2017 Wu ..... H01H 13/14

* cited by examiner

*Primary Examiner* — Vanessa Girardi
(74) *Attorney, Agent, or Firm* — Rosenberg, Klein & Lee

(57) ABSTRACT

A switch wire connection device has a simplified structure and is easy to operate with enhanced stability of operation. The switch wire connection device includes a conductive component mounted in an insulation case, a switch pushbutton assembled with the conductive component and an electrical contact. The electrical contact has a restriction unit and a contact plate connected with the restriction unit. By means of operating the pushbutton, the conductive component is driven to selectively electrically contact or separate from the contact plate. The restriction unit is divided into a first space and a second space, in which a first leg section and a second leg section of a metal leaf spring are respectively assembled. The wiring circuits or conductive wires can be easily directly plugged into the first and second spaces of the restriction unit and held by the first and second leg sections.

36 Claims, 10 Drawing Sheets

SWITCH WIRE CONNECTION DEVICE

BACKGROUND OF THE INVENTION

1. Field of the Invention

The present invention relates generally to an improved switch wire connection device, and more particularly to a switch wire connection device including a restriction unit, a contact plate and a metal leaf spring assembled with each other for directly electrically connecting with a conductive wire. The restriction unit has higher rigidity and is able to help in fixing the metal leaf spring and restricting the moving path thereof.

2. Description of the Related Art

A conventional switch wire connection device is a power switch device capable of connecting circuits or conductive wires. The switch wire connection device is installed on an operation panel or distribution box of an electronic or electrical apparatus for connecting the wiring circuits. The switch wire connection device has an insulation case (generally made of plastic material) and a conductive component enclosed in the insulation case and a screw for locking the wiring circuits or conductive wires of the electronic or electrical apparatus. By means of operating a switch pushbutton, the conductive component is controlled to electrically contact or separate from the wiring circuits or the conductive wires so as to close the circuit to power on the electronic or electrical apparatus or open the circuit to power off the electronic or electrical apparatus.

With respect to operation, use and structural design of the switch wire connection device, the insulation case is formed with wire sockets and screw locking holes in communication with each other. An operator can use a tool to drive the screw to lock a conductive wire plugged into the wire socket. In practice, the screw must be first positioned in the screw locking hole in a loosened state, permitting the conductive wire to plug into the wire socket. In the loosened state, the screw is often deflected. Under such circumstance, it is troublesome and hard for the operator to aim the tool at the screw to drive the screw for locking the conductive wire with the electrical contact (or termed electrical connection terminal).

To improve the above problem, there is a conventional switch wire connection device in which the insulation case and the electrical contact are formed with guide channels and guide ribs in cooperation with the spring. Such structure is relatively complicated so that the manufacturing cost is increased and generally the volume of the case is enlarged to avoid interference between the guide structures and the conductive component. The increase of the volume of the case is unbeneficial to the miniaturization of the switch wire connection terminal device and fails to meet the trend to miniaturize the switch wire connection terminal device.

Also, in some operation environments (such as the operation of the machine or the equipment will cause vibration), after a long term of use, the screw is apt to loosen. As a result, the conductive wire may loosen and detach from the case. Especially, when driving the screw mechanism to lock the conductive wires with the electrical contact, it is necessary to use a tool for tightening/untightening the screw. Such process is relatively troublesome. This is not what we expect.

There is another conventional switch wire connection device in which the case is designed with a specific internal structure and an α-shaped metal leaf spring is applied to the case for pressing the conductive wires instead of the screw mechanism. However, as known by those who are skilled in this field, the α-shaped metal leaf spring is manufactured by a special bending process and it is necessary to form a mouth section on the metal leaf spring for the other end of the metal leaf spring to swingably pass through the mouth section for pressing the conductive wire. The manufacturing process of the α-shaped metal leaf spring is quite troublesome and complicated. This is not what we expect.

To speak representatively, the conventional switch wire connection device has some shortcomings in structural design and operational form. To overcome the above shortcomings, it is necessary to redesign the insulation case, the conductive component, the electrical contact and the metal leaf spring and change the use form of the switch wire connection device and widen the application range thereof. For example, in the condition that the volume of the switch wire connection device is not increased, the switch wire connection device is redesigned to have a simplified structure, which is easy to manufacture and operate. In the conventional switch wire connection device, it is hard and troublesome for an operator to aim the tool at the screw to drive the screw for locking the conductive wire with the electrical contact. In addition, it is troublesome to assemble the guide channels and guide ribs of the insulation case and the electrical contact and the spring. Also, an α-shaped metal leaf spring is applied to the insulation case and the structure of the switch wire connection device is complicated. After redesigned, all the above shortcomings of the conventional switch wire connection device are overcome.

After redesigned, the switch wire connection device includes an electrical contact having a restriction unit and a contact plate. The restriction unit has a first space and a second space. At least two side by side conductive wires can be plugged into the case to be respectively held a metal leaf spring. Moreover, without using any tool, an operator can directly plug the conductive wires into the case to electrically connect with the electrical contact. The electrical contact has higher rigidity or hardness and good electrical conductivity and is able to help in fixing the metal leaf spring and restricting the moving path thereof. All these are not substantially taught, suggested or disclosed in the conventional switch wire connection devices.

SUMMARY OF THE INVENTION

It is therefore a primary object of the present invention to provide an improved switch wire connection device, which has a simplified structure and is easy to operate with enhanced stability of operation. The switch wire connection device includes a conductive component mounted in an insulation case, a switch pushbutton assembled with the conductive component and an electrical contact. The electrical contact has a restriction unit and a contact plate connected with the restriction unit. By means of operating the pushbutton, the conductive component is driven to selectively electrically contact or separate from the contact plate. The restriction unit is divided into a first space and a second space, in which a first leg section and a second leg section of a metal leaf spring are respectively assembled. The wiring circuits or conductive wires of a machine or equipment can be easily directly plugged into the first and second spaces of the restriction unit and held by the first and second leg sections of the metal leaf spring. In addition, during the operation process, the metal leaf spring is prevented from deflecting.

In the above switch wire connection device, the restriction unit and the contact plate are formed as an integrated structure. The restriction unit has a first side, a second side connected with the first side, a third side connected with the second side and a fourth side connected with the third side. The first, second, third and fourth sides together form a cuboidal frame structure.

In the above switch wire connection device, the first side is bent toward the third side and extends to form a first subsidiary side. The fourth side is bent toward the second side and extends to form a fifth side. The fifth side and the first side are positioned on the same plane. The fifth side is bent toward the third side and extends to form a second subsidiary side. The first and second subsidiary sides are side by side arranged in parallel to each other to divide the restriction unit into a first space and a second space for respectively receiving the first and second leg sections of the metal leaf spring. At least the second side and the first subsidiary side serve to help in restricting the moving path of the first leg section of the metal leaf spring and the fourth side and the second subsidiary side serve to help in restricting the moving path of the second leg section of the metal leaf spring. The contact plate has a first end and a second end. The first end is connected with the first and fifth sides of the restriction unit. The second end is an inclined and lifted structure and extends in a direction to contact the conductive component.

In the above switch wire connection device, the first subsidiary side is formed with a first raised section directed to the second subsidiary side. The second subsidiary side is formed with a second raised section directed to the first subsidiary side. The first and second raised sections serve to compensate the gap between the first and second subsidiary sides, whereby when operating and moving the metal leaf spring, the first and second raised sections together prevent the first and second subsidiary sides from over-deflecting or over-swing. Accordingly, the moving path of the metal leaf spring can be truly restricted.

The present invention can be best understood through the following description and accompanying drawings, wherein:

BRIEF DESCRIPTION OF THE DRAWINGS

FIGS. 2A to 2E are sectional views of the restriction units of the present invention, showing the structural cooperation between the first subsidiary side and/or the second subsidiary side, wherein FIG. 2A shows that there is only one subsidiary side and FIGS. 2B to 2E show that there are two subsidiary sides and FIGS. 2C to 2E show that a gap s is defined between the two subsidiary sides and FIG. 2D shows that the two subsidiary sides are formed with raised sections in the gap s;

DETAILED DESCRIPTION OF THE PREFERRED EMBODIMENTS

Figure 1:
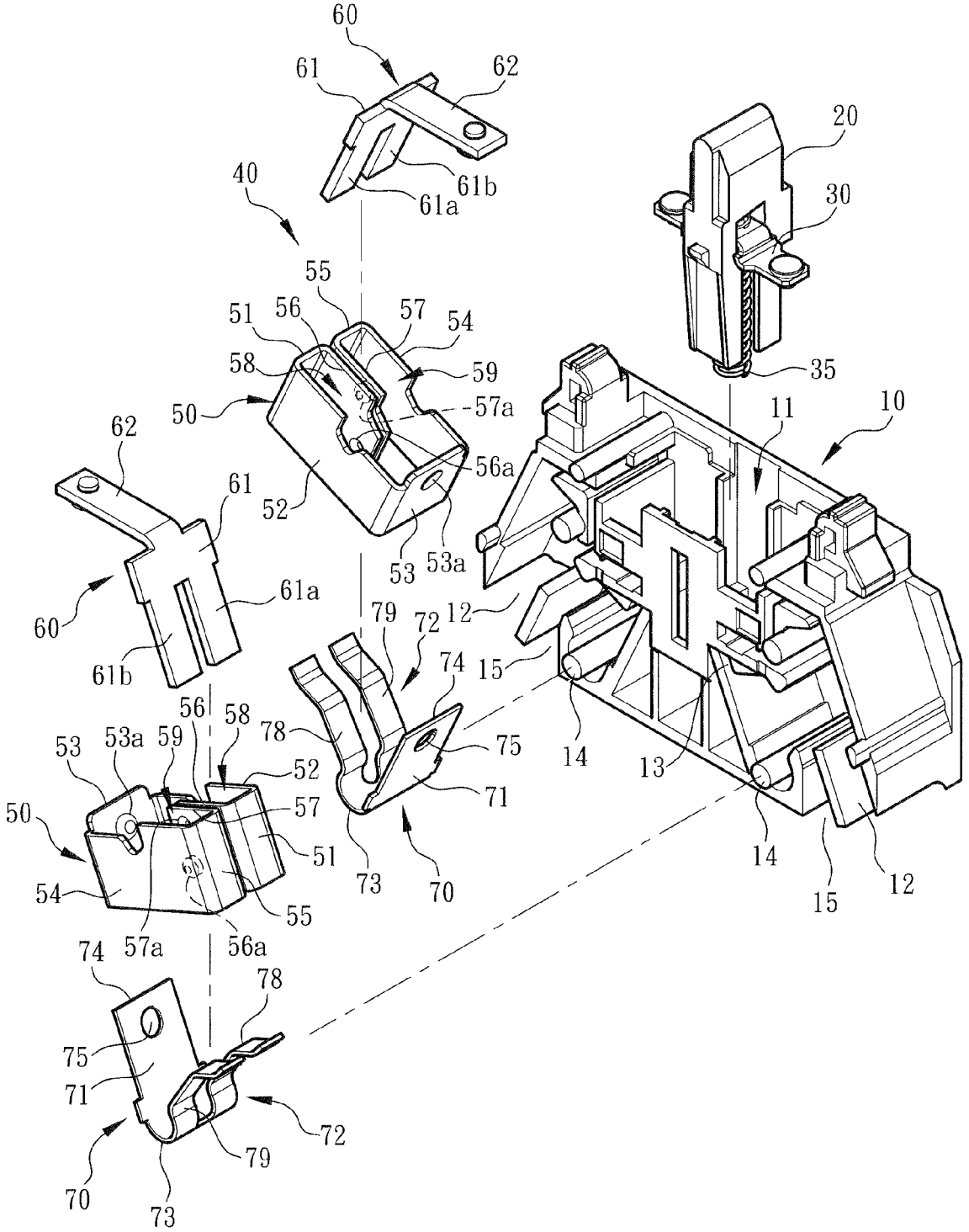
FIG. 1 is a perspective exploded view of the present invention, showing the structures of the case, the switch pushbutton, the conductive component and the restriction unit and contact plate of the electrical contact and the metal leaf spring.
Figure 3:
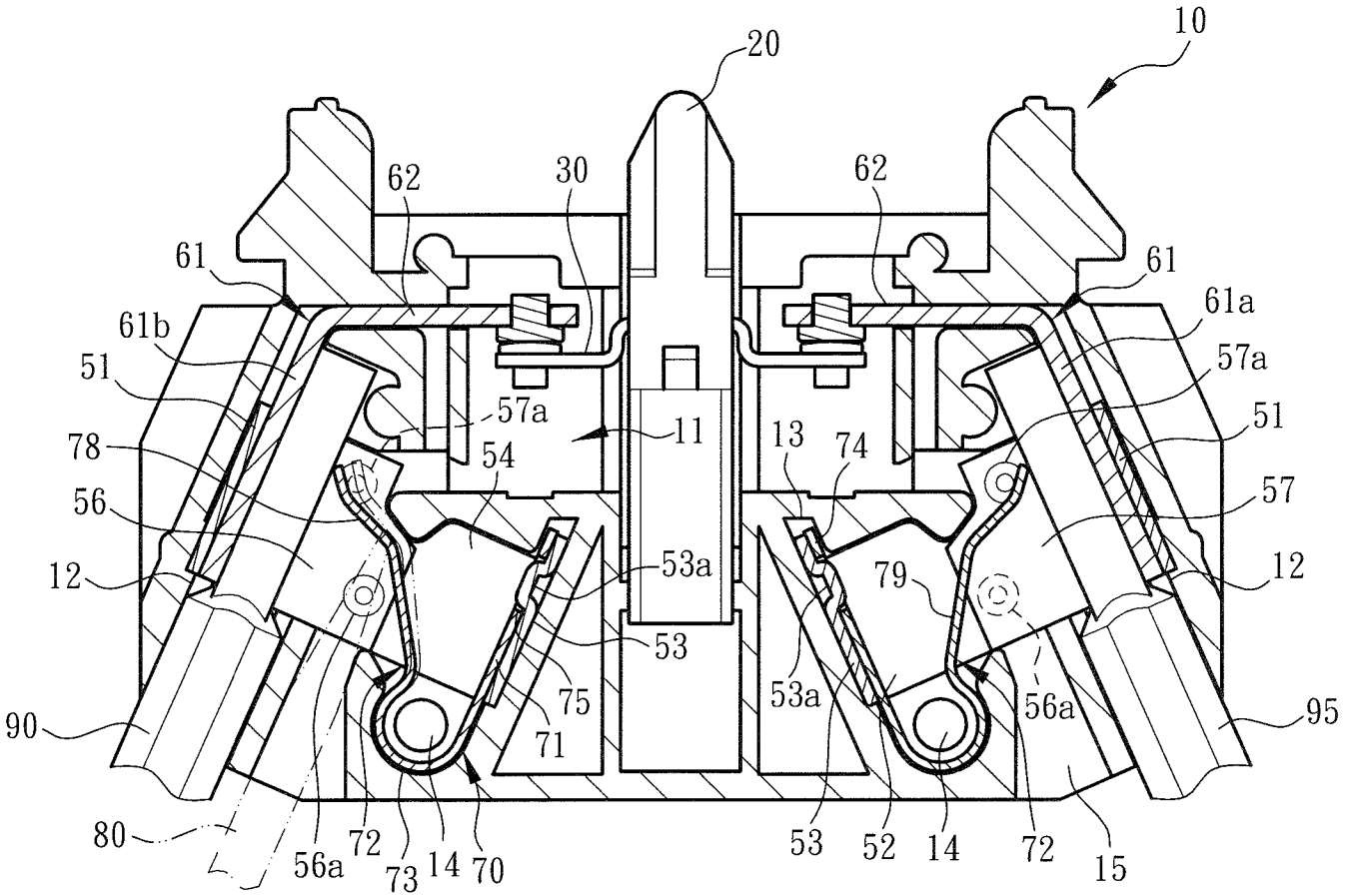
FIG. 3 is a sectional assembled view of the present invention, showing the assembly of the case, the switch pushbutton, the conductive component and the restriction unit and contact plate of the electrical contact and the metal leaf spring.

Please refer to FIGS. 1 and 3. The switch wire connection device of the present invention includes an insulation case 10 and a switch pushbutton 20 assembled with the insulation case 10. The case 10 has a cavity 11 for receiving the switch pushbutton 20. The switch pushbutton 20 is assembled with a conductive component 30 and a spring 35. (This pertains to prior art and thus will not be further described hereinafter). According to the direction of FIG. 1, the lower end sections of two sides of the case 10 are formed with wire sockets 12 in communication with the cavity 11. The wiring circuits or conductive wires 90 of an electronic or an electrical apparatus can be plugged through the wire sockets 12 into the cavity 11 to connect with the electrical contact 40.

Basically, according to the practical application form, the switch wire connection device of the present invention permits at least two conductive wires 90 to side by side plug into the case 10 and connect with the electrical contact 40 for illustration purposes. That is, at least two conductive wires 90 or 95 can be pivotally connected with one electrical contact 40.

As shown in the drawings, there are two electrical contacts 40 disposed in the cavity 11 of the case. Each electrical contact 40 includes a restriction unit 50 and a contact plate 60 connected with the restriction unit 50. The restriction unit 50 is selectively made of a plane-plate blank material with higher rigidity or hardness, (such as iron or steel). The plane-plate blank material is manufactured into the restriction unit 50 in the form of a cuboidal frame structure as shown in FIG. 1 to be assembled with the contact plate 60.

As shown in the drawings, the restriction unit 50 has a first side 51, a second side 52 connected with the first side 51, a third side 53 connected with the second side 52, a fourth side 54 connected with the third side 53 and a fifth side 55 connected with the fourth side 54 and extending toward the second side 52, which together form a cuboidal frame structure to receive therein a metal leaf spring 70.

Figure 2A:
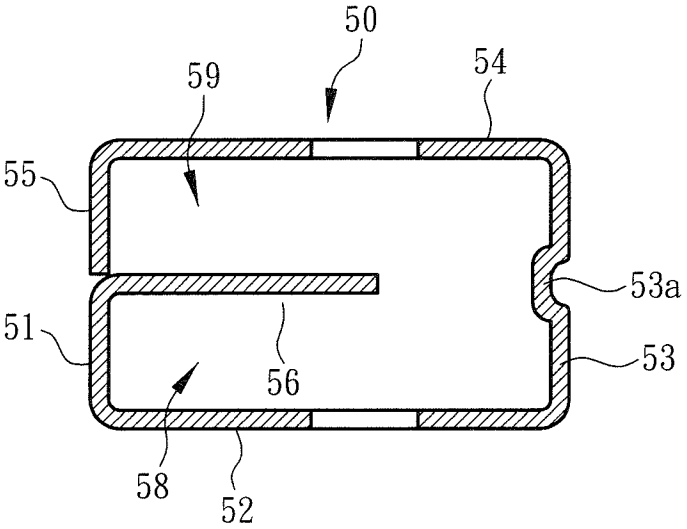
Figure 2C:
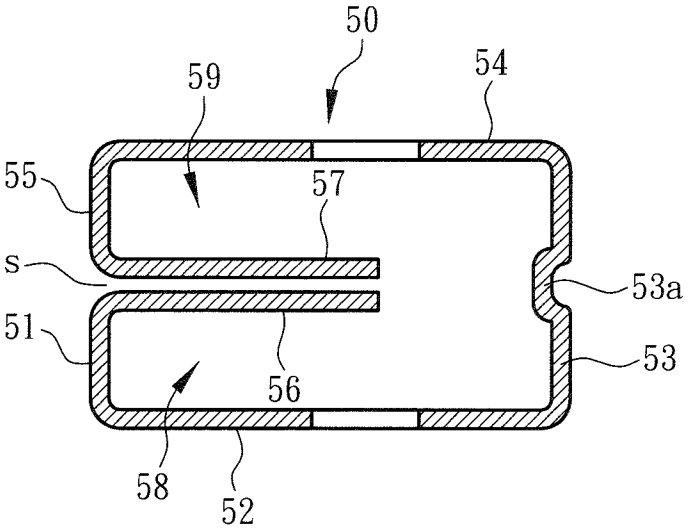
Figure 2B:
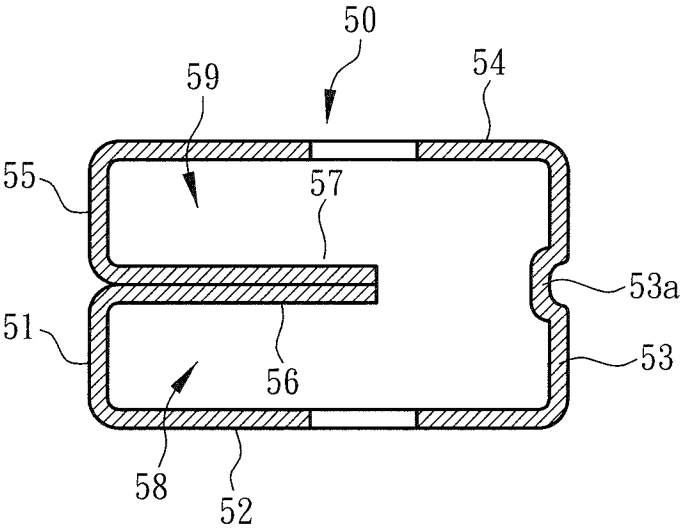
Figure 2E:
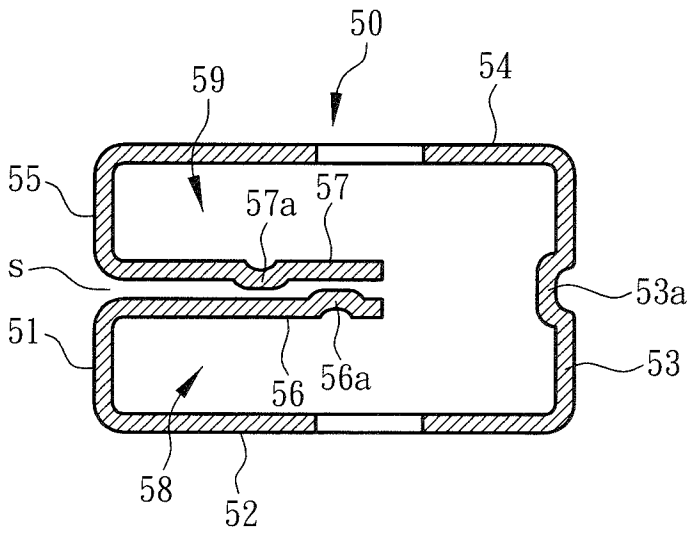
Figure 2D:
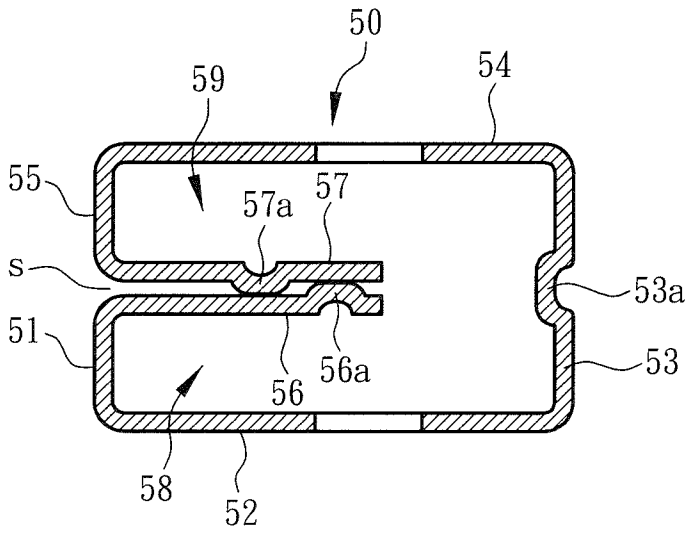

In this embodiment (as shown in FIGS. 2A to 2E), at least one of the first and fifth sides 51, 55 (as shown in FIG. 2A) is bent toward the third side 53 and extends to form a first subsidiary side 56. (For example, the first side 51 and the first subsidiary side 56 contain an acute angle, a right angle or an obtuse angle). The fifth side 55 and the first side 51 are positioned on the same plane. The fifth side 55 can be further bent toward the third side 53 and extend to form a second subsidiary side 57. (As shown in FIGS. 2A to 2E, the fifth side 55 and the second subsidiary side 57 contain an acute angle, a right angle or an obtuse angle). The first and second subsidiary sides 56, 57 are side by side arranged in parallel to each other. Accordingly, the restriction unit 50 is divided into a first space 58 and a second space 59.

Referring to FIGS. 2B to 2E, due to the bending operation, a gap s or no gap (FIG. 2B) is formed between the first and second subsidiary sides 56, 57. Further refer to FIGS. 2D and 2E, the first subsidiary side 56 is formed with a first raised section 56*a* directed to the second subsidiary side 57. The second subsidiary side 57 is formed with a second raised section 57*a* directed to the first subsidiary side 56. The first and second raised sections 56*a*, 57*a* serve to compensate or minify the gaps between the first and second subsidiary sides 56, 57, whereby when operating and moving the metal leaf spring 70, the first and second raised sections 56*a*, 57*a* together prevent the first and second subsidiary sides 56, 57 from over-deflecting or over-swing. In this case, the moving path of the metal leaf spring 70 is truly restricted. The gaps exists to provide the first subsidiary side 56 and/or the second subsidiary side 57 with certain elasticity. Accordingly, when pushing/shifting the metal leaf spring 70, the first subsidiary side 56 and/or the second subsidiary side 57 can slightly deflect to frictionally engage with the metal leaf spring 70 and give certain disengagement freeness to the metal leaf spring 70.

In this embodiment, the contact plate 60 has a first end 61 and a second end 62. The first end 61 is a forked structure having a first finger section 61*a* and a second finger section 61*b* corresponding to the first and fifth sides 51, 55 (or the first and second spaces 58, 59) of the restriction unit. The first and second finger sections 61*a*, 61*b* are respectively connected with the first and fifth sides 51, 55 of the restriction unit. The second end 62 is an inclined and lifted structure and extends in a direction to contact the conductive component 30. The switch pushbutton 20 selectively controls the conductive component 30 into electrical contact with the second end 62 of the contact plate or separation from the second end 62.

To speak more specifically, when an operator presses the switch pushbutton 20, the conductive component 30 is driven into electrical contact with or separation from the contact plate 60 or the second end 62 thereof, whereby the electrical contact 40 is powered on or powered off.

As shown in the drawings, the metal leaf spring 70 is substantially in the form of a V-shaped body having an opening. The metal leaf spring 70 includes a first section 71, a second section 72 and a bent section 73 connected between the first and second sections 71, 72. The first section 71 has a head end 74 and an assembling section 75 in the form of a perforation. The assembling section 75 can be assembled on an assembling section 53*a* in the form of a raised section formed on the third side 53 of the restriction unit, whereby the first section 71 of the metal leaf spring is positioned in the restriction unit 50. Moreover, the head end 74 of the first section 71 of the metal leaf spring and an upper end section of the third side 53 of the restriction unit are together fixed in a recess 13 of the cavity 11 of the case. The bent section 73 of the metal leaf spring is wound on a stake 14 in the cavity 11 of the case, whereby the second section 72 of the metal leaf spring extends into the restriction unit 50 and can swing within the restriction unit 50.

To speak more specifically, the second section 72 of the metal leaf spring is a forked structure having a first leg section 78 and a second leg section 79. The first and second leg section 78, 79 are respectively received in or extended into the first and second spaces 58, 59 of the restriction unit. In addition, the second side 52 and the first subsidiary side 56 of the restriction unit serve to help in restricting the moving path of the first leg section 78 of the metal leaf spring. The fourth side 54 and the second subsidiary side 57 of the restriction unit serve to help in restricting the moving path of the second leg section 79 of the metal leaf spring. It should be noted that the structural form of the second side 52 and the first subsidiary side 56 of the restriction unit and the fourth side 54 and the second subsidiary side 57 of the restriction unit and the cooperative gap s allows the restriction unit 50 to have an elastic freeness. This can reduce the frictional engagement or stagnation between the second side 52 and the first subsidiary side 56 and the first leg section 78 of the metal leaf spring and the fourth side 54 and the second subsidiary side 57 and the second leg section 79 of the metal leaf spring. Accordingly, the smoothness of the move of the metal leaf spring 70 can be enhanced.

In this embodiment, after the metal leaf spring 70 is mounted in the cavity 11 of the case, the opening of the metal leaf spring is directed to the conductive component 30. In this case, the second section 72 is arranged in such an angle that the conductive wires 90 or 95 can be easily plugged and assembled with the case. Moreover, the plug-in direction or angle of the conductive wires 90 or 95 is approximately equal to the inclination angle of the first end 61 (the first finger section 61*a* or the second finger section 61*b*) of the contact plate. Therefore, the conductive wires 90 or 95 can contact the first end 61 (the first finger section 61*a* or the second finger section 61*b*) of the contact plate by larger area than the conventional structure and get closer to the conductive component 30. This enhances the electrical conduction efficiency and assembling stability. Such structure is obviously different from the α-shaped metal leaf spring or screw mechanism used in the conventional technique for locking and connecting with the conductive wire.

Figure 4:
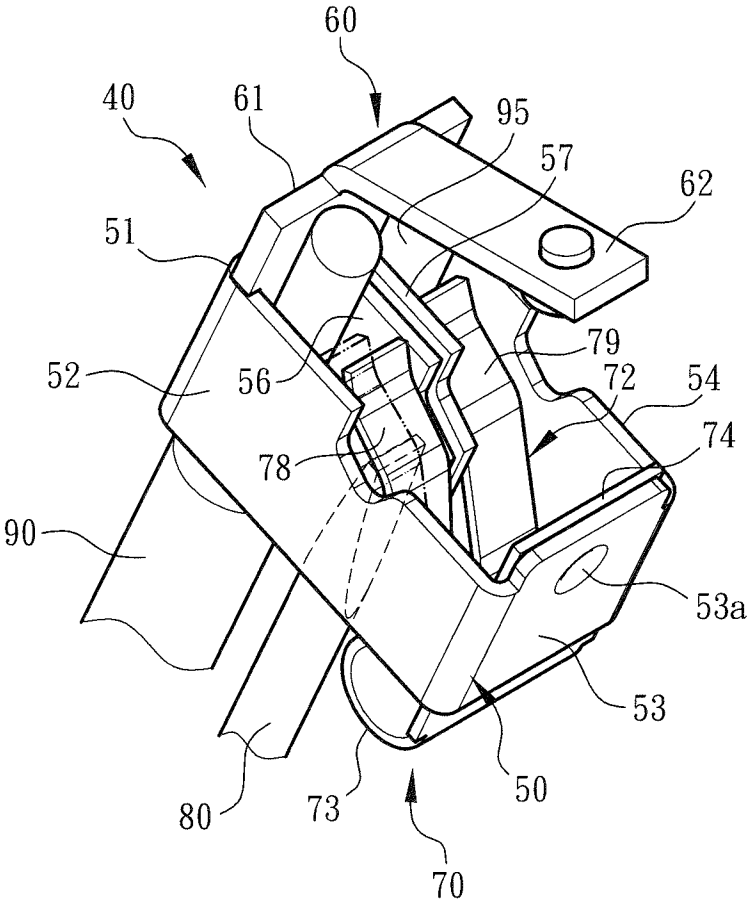
FIG. 4 is a perspective view showing the cooperation between the electrical contact, the metal leaf spring and the conductive wires of the present invention.

Referring to FIGS. 3 and 4, one single conductive wire 90 or two side by side conductive wires 90, 95 can be directly plugged into the wire socket 12 and the restriction unit 50. The tail end of the first leg section 78 of the metal leaf spring presses the conductive wire 90 against the first finger section 61*a* of the contact plate into electrical contact therewith. The tail end of the second leg section 79 of the metal leaf spring presses the conductive wire 95 against the second finger section 61*b* of the contact plate into electrical contact therewith. At this time, the conductive component 30 is positioned in a position in contact with the second end 62 of the contact plate in a power-on state. When an operator presses the switch pushbutton 20, the conductive component 30 is moved downward according to the direction of the drawing, whereby the conductive component 30 is separated from the second end 62 of the contact plate into a power-off state.

Please refer to FIGS. 3 and 4. The metal leaf spring 70 is such received in the restriction unit 50 that the second side 52 and the first subsidiary side 56 of the restriction unit at least together restrict the moving path of the first leg section 78 of the metal leaf spring so as to prevent the first leg section 78 from deflecting or swinging to two sides. Also, the fourth side 54 and the second subsidiary side 57 together restrict the moving path of the second leg section 79 of the metal leaf spring so as to prevent the second leg section 79 from deflecting or swinging to two sides. This helps in enhancing the stability of the move of the metal leaf spring 70 and the assembling of the metal leaf spring 70 with the conductive wires 90 and/or 95.

Especially, when plugging the conductive wires 90 and/or 95 into the cavity 11 of the case and the first space 58 and/or second space 59 of the restriction unit 50, the conductive wires 90 and/or 95 will be restricted in the first space 58 and/or second space 59 of the restriction unit 50 with high hardness. Therefore, the bare metal end of the conductive wire will not thrust or scrape and break the case as happening in the conventional technique. Also, the conductive wire will not swing within the interior of the case by an excessively large angle or twist to stretch open the case due to the operational environment, the operational situation (such as the vibration caused by the operation of the machine or equipment) or a collision due to negligence.

Further referring to FIGS. 3 and 4, an operator can extend a tool 80 from an operation hole 15 of lower end of the case 10 into the cavity 11 and the first space 58 or the second space 59 of the restriction unit to push the first leg section 78 or the second leg section 79 of the metal leaf spring and make the tail end of the first leg section 78 or the tail end of the second leg section 79 leave the conductive wire 90 or 95. Under such circumstance, the conductive wire 90 or 95 is released from the pressing of the second section 72 of the metal leaf spring, whereby the operator can directly detach the conductive wire 90 or 95 from the case 10.

Figure 5:
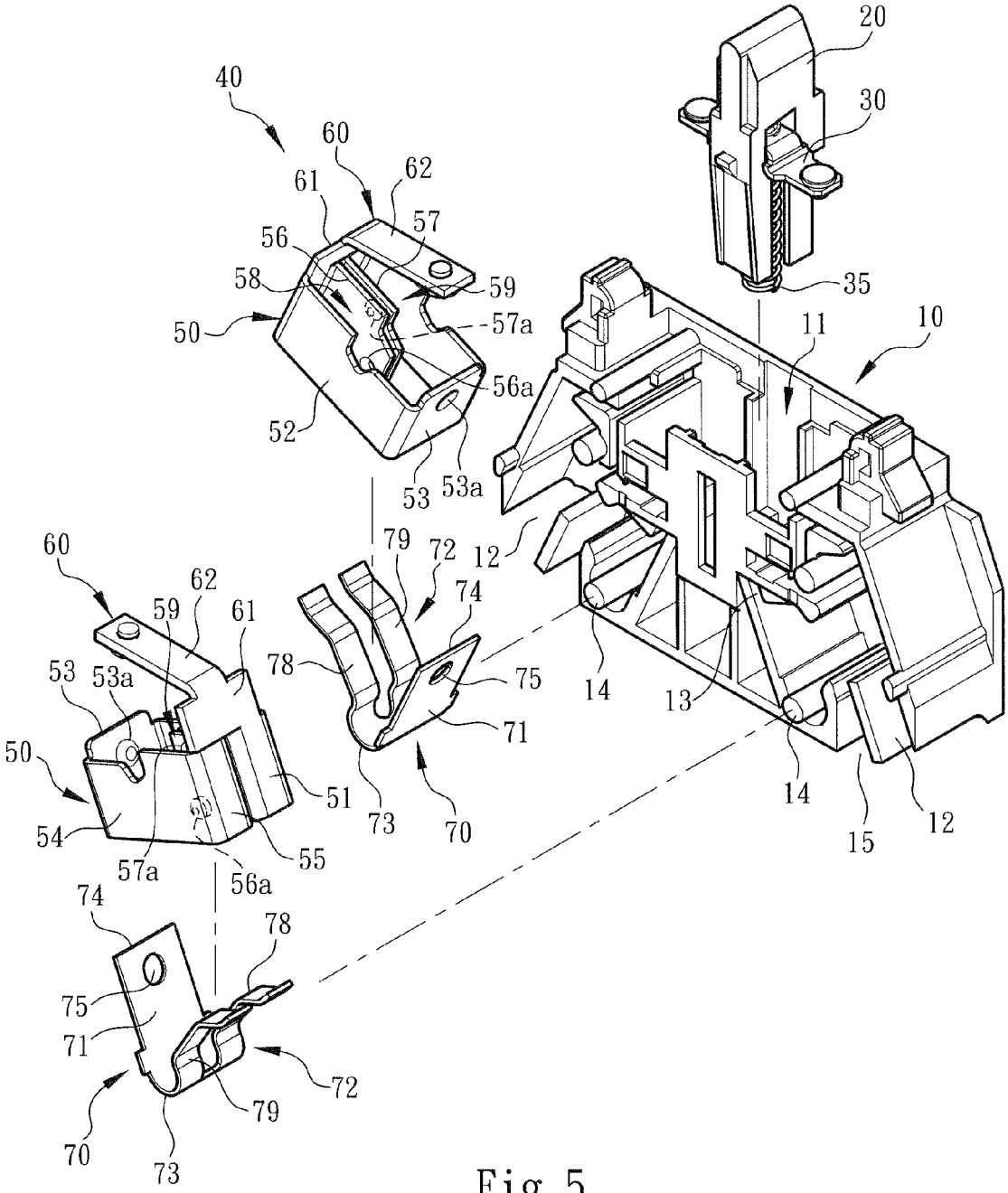
FIG. 5 is a perspective exploded view of a preferred embodiment of the present invention, showing that the restriction unit and the contact plate are formed as an integrated structure.

Please now refer to FIG. 5. In a modified embodiment, the restriction unit 50 and the contact plate 60 are formed as an integrated structure. That is, the first finger section 61*a* of the first end 61 of the contact plate is integrally connected with the first side 51 of the restriction unit and the second finger section 61*b* is connected with the fifth side 55 of the restriction unit.

Figure 6:
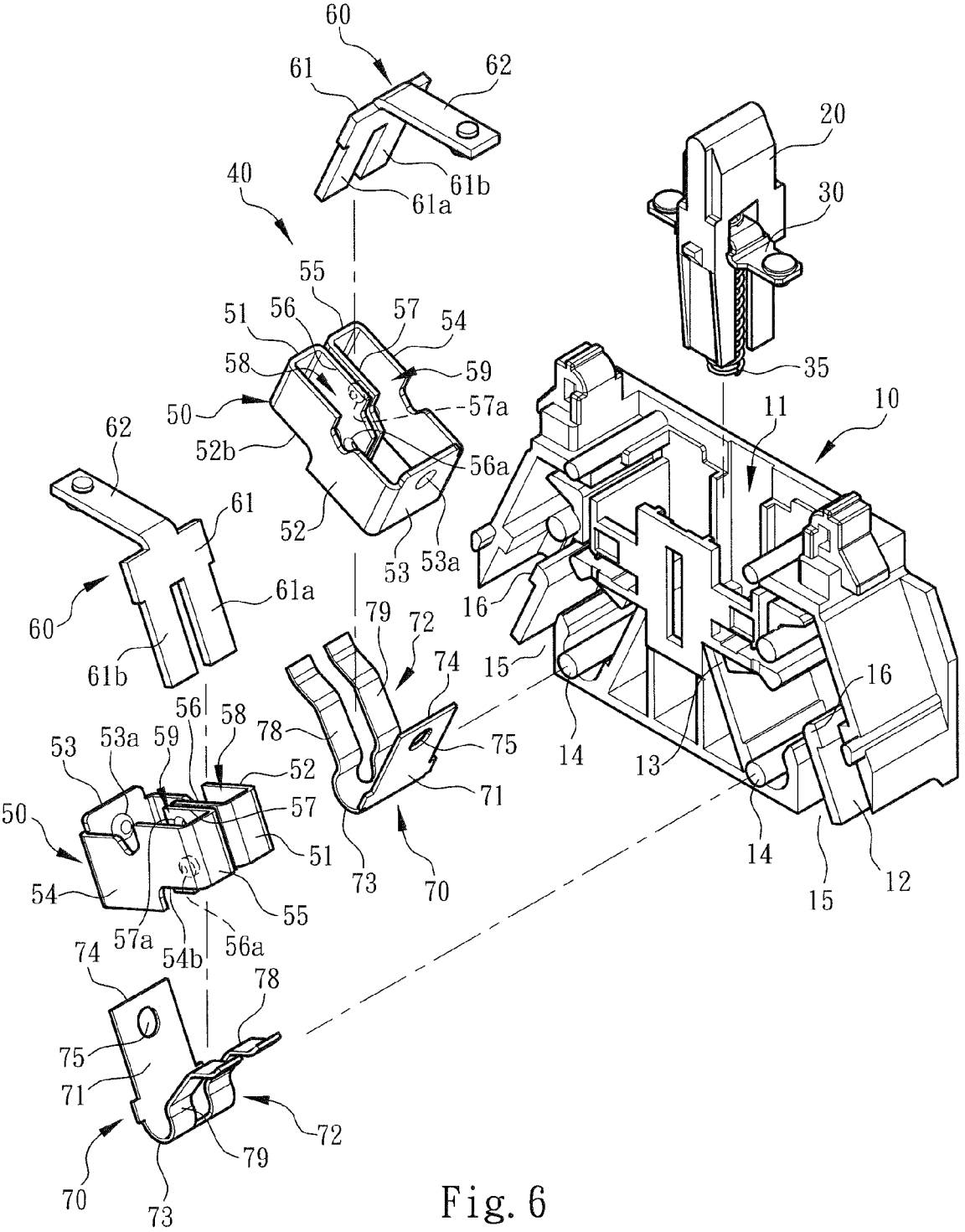
FIG. 6 is a perspective exploded view of another preferred embodiment of the present invention, showing that the second and fourth sides of the restriction unit of the electrical contact are formed with notches.

Please now refer to FIG. 6. In a modified embodiment, according to the configuration of the cavity 11 of the case, the second and fourth sides 52, 54 of the restriction unit 50 are formed with notches 52*b*, 54*b* for leaning on a shoulder section 16 formed on the case 10 or the cavity 11. Under such circumstance, the restriction unit 50 is more securely assembled with the case 10.

Figure 7:
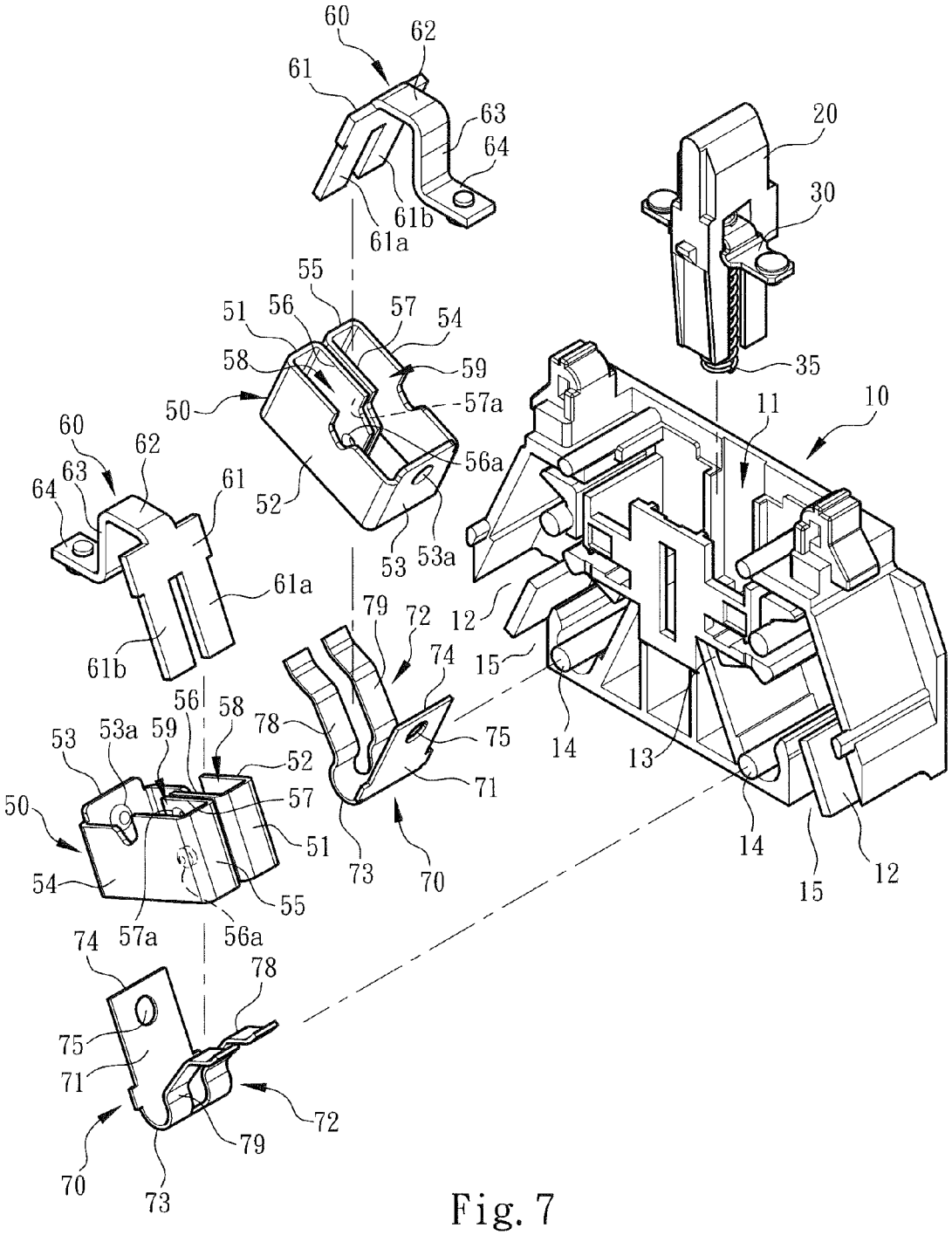
FIG. 7 is a perspective exploded view of still another preferred embodiment of the present invention, showing another embodiment of the contact plate of the electrical contact.
Figure 8:
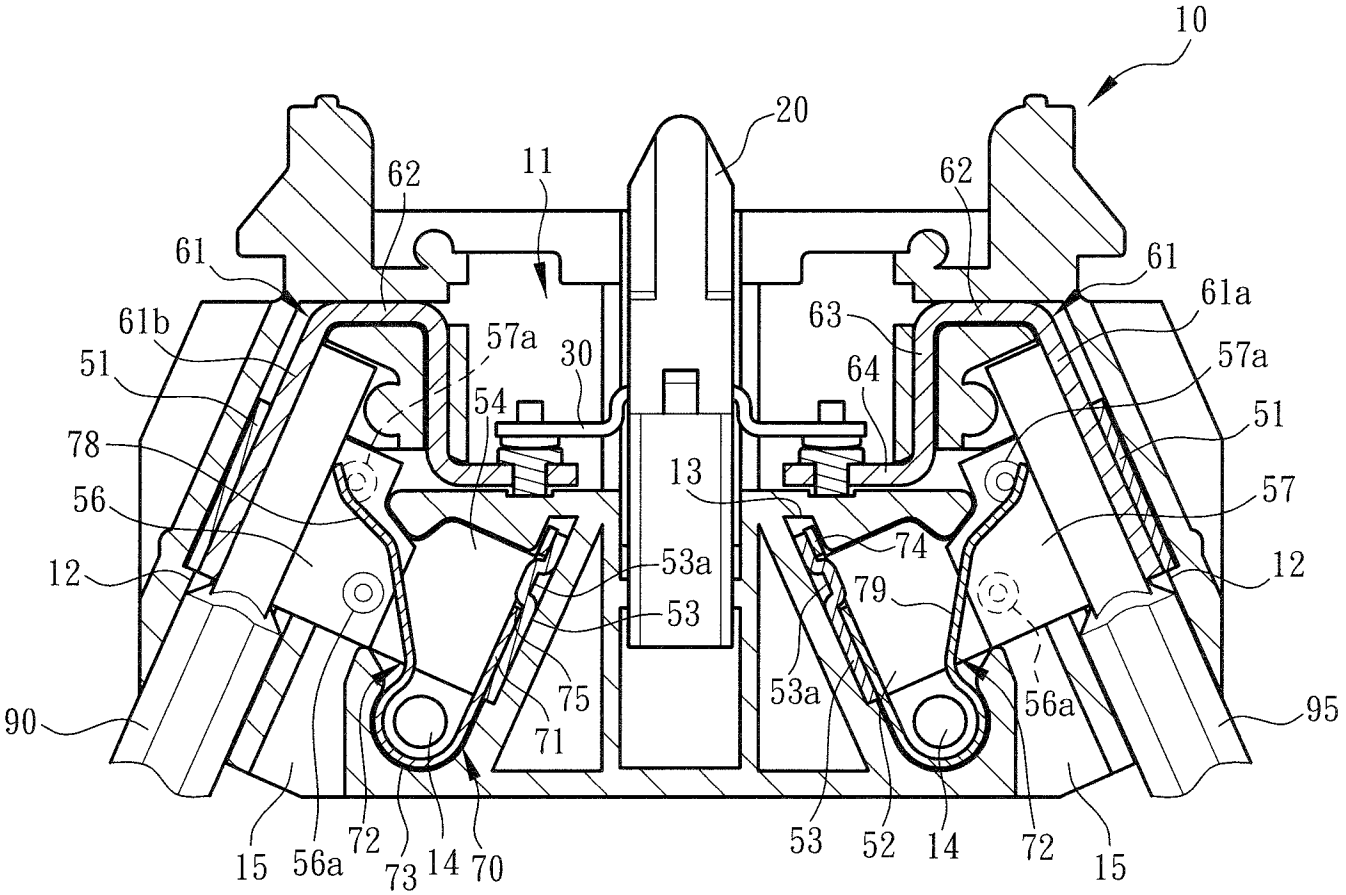
FIG. 8 is a sectional assembled view according to FIG. 7, showing the assembly of the case, the switch pushbutton, the conductive component, the conductive wires, the restriction unit and contact plate of the electrical contact and the metal leaf spring.

Please now refer to FIGS. 7 and 8. In a modified embodiment of the electrical contact 40, according to the assembling form of the case 10 (or the cavity 11) and the switch pushbutton 20, the second end 62 of the contact plate of the electrical contact 40 is bent toward the restriction unit 50 (or the first and second spaces 58, 59 or the lower side of the drawing or the opening of the metal leaf spring 70) and extends to forma subsidiary end 63. (For example, the second end 62 and the subsidiary end 63 contain an acute angle, a right angle or an obtuse angle). The subsidiary end 63 is further bent toward the conductive component 30 or the switch pushbutton 20 and extends to form a tail end 64. (For example, the subsidiary end 63 and the tail end 64 contain an acute angle, a right angle or an obtuse angle).

As shown in FIG. 8, after an operator operates the switch pushbutton 20 to drive the conductive component 30 to move toward the lower side of the drawing, the conductive component 30 will contact the tail end 64 of the contact plate into a power-on state. When the operator operates the switch pushbutton 20 to drive the conductive component 30 to move toward the upper side of the drawing, the conductive component 30 is separated from the tail end 64 of the contact plate into a power-off state.

To speak representatively, the switch wire connection device of the present invention meets the trend to miniaturize the switch wire connection terminal device without increasing the volume of the case. In comparison with the conventional device, the switch wire connection device of the present invention has the following advantages:

1. The case 10, the switch pushbutton 20, the conductive component 30, the restriction unit 50, the contact plate 60, the metal leaf spring 70 and the relevant components and structures have been redesigned. For example, the restriction unit 50 has a first side 51, a second side 52, a third side 53, a fourth side 54 and/or a fifth side 55. The first side 51 is bent to form a first subsidiary side 56. The fifth side 55 is bent to form a second subsidiary side 57 to together form a frame structure having a first space 58 and a second space 59 for receiving the first and second leg sections 78, 79 of the metal leaf spring 70. The metal leaf spring 70 has a first section 71 inlaid or connected with the third side 53 of the restriction unit. The bend section 73 is wound on the stake 14 of the case 10, whereby the first and second leg sections 78, 79 of the second section 72 are restricted to move within the first and second spaces 58, 59 of the restriction unit. An operator can directly plug the conductive wires 90 and/or 95 into the cavity 11. The first and second leg sections 78, 79 of the metal leaf spring respectively press the conductive wires 90 and/or 95 against restriction unit. The contact plate 60 has a first end 61 and a second end 62. The first end 61 has a first finger section 61*a* and a second finger section 61*b* respectively connected with the first and fifth sides 51, 55 of the restriction unit. The switch pushbutton 20 can selectively control the conductive component 30 into electrical contact with the second end 62 or separation from the second end 62. The structure of the switch wire connection device of the present invention is obviously different from the conventional device in use and operational form.
2. Especially, according to the conventional device, it is necessary to tighten or untighten the screw for locking or unlocking the wiring circuit or the conductive wire. This is quite troublesome. In addition, when the screw is in a loosened state, the screw is often deflected so that an operator can hardly aim the tool at the screw to drive the screw for locking the conductive wire with the electrical contact. In addition, in the conventional device, an α-shaped metal leaf spring is applied to the insulation case. The insulation case and the electrical contact are respectively formed with guide channels and guide ribs in cooperation with the spring. Such structure is relatively complicated so that the manufacturing cost is increased and the volume of the case is enlarged. Moreover, the vibration caused by the operation of the machine or the equipment will lead to loosening of the screw. As a result, the conductive wire is apt to loosen and detach from the case. The present invention overcomes all the above shortcomings of the conventional device.
3. The electrical contact 40 has higher rigidity or hardness and has good electrical conductivity so that the electrical contact is able to help in fixing the metal leaf spring 70 and guiding the metal leaf spring 70 to move a true path. In addition, the restriction unit 50 serves to correspondingly receive the metal leaf spring 70 and the conductive wires 90, 95. This facilitates the operation of an operator. In the conventional device, the bare metal end of the conductive wire often thrusts and damages the case and the metal leaf spring often deflects or swings within the interior of the case to scrape and break the case. In addition, the conductive wire can be hardly securely held in the case. The present invention overcomes all the above shortcomings of the conventional device.
4. Furthermore, the restriction unit 50 is formed with the first and second spaces 58, 59 for correspondingly receiving the first and second leg sections 78, 79 of the metal leaf spring. The second side 52 and the first subsidiary side 56 restrict the moving path of the first leg section 78. Also, the fourth side 54 and the second subsidiary side 57 restrict the moving path of the second leg section 79. Also, different conductive wires 90, 95 can be side by side plugged into the case or unplugged out of the case. The structural design of the present invention is apparently more idealistic than the conventional device.

In conclusion, the switch wire connection device of the present invention is effective and different from the conventional device in space form. The switch wire connection device of the present invention is inventive, greatly advanced and advantageous over the conventional device.

The above embodiments are only used to illustrate the present invention, not intended to limit the scope thereof. Many modifications of the above embodiments can be made without departing from the spirit of the present invention.

What is claimed is:

1. A switch wire connection device comprising an insulation case and a switch pushbutton assembled with the insulation case, the case having a cavity for receiving the switch pushbutton, the switch pushbutton being assembled with a conductive component and a spring, the case being formed with wire sockets in communication with the cavity, an electrical contact being disposed in the cavity of the case, the electrical contact having a restriction unit and a contact plate connected with the restriction unit, the contact plate having a first end and a second end, the first end being connected with the restriction unit, the switch pushbutton serving to control the conductive component into electrical contact with the second end of the contact plate or separation from the second end of the contact plate, the restriction unit being formed with a first space and a second space for receiving a metal leaf spring, the metal leaf spring including a first section and a second section, the first section being assembled with the restriction unit and together mounted in the cavity of the case, the second section having a first leg section and a second leg section, the first and second leg section being respectively swingably received in the first and second spaces of the restriction unit.

2. The switch wire connection device as claimed in claim 1, wherein the wire sockets are formed on lower end sections of two sides of the case, two side by side conductive wires being allowed to respectively plug through the wire sockets into the first and second spaces of the restriction unit, whereby the first and second leg sections of the metal leaf spring respectively presses the side by side conductive wires against the first end of the contact plate, the plug-in angle of the conductive wires being equal to the inclination angle of the first end of the contact plate, an operation hole being formed at a lower end of the case in communication with the cavity and the first and second spaces of the restriction unit.

3. The switch wire connection device as claimed in claim 1, wherein the restriction unit and the contact plate are formed as an integrated structure.

4. The switch wire connection device as claimed in claim 1, wherein the restriction unit has a first side, a second side connected with the first side, a third side connected with the second side and a fourth side connected with the third side, the first, second, third and fourth sides together forming a cuboidal frame structure, the fourth side being bent toward the second side and extending to forma fifth side, the fifth side and the first side being positioned on the same plane, at least one of the first and fifth sides being bent toward the third side and extending to format least one subsidiary side between the first and second spaces.

5. The switch wire connection device as claimed in claim 4, wherein the first end of the contact plate has a first finger section and a second finger section, the first and second finger sections being respectively connected with the first and fifth sides of the restriction unit, the second end of the contact plate being an inclined and lifted structure and extending in a direction to contact the conductive component.

6. The switch wire connection device as claimed in claim 4, wherein the restriction unit and the contact plate are formed as an integrated structure, the first finger section of the first end of the contact plate being integrally connected with the first side of the restriction unit, the second finger section of the first end of the contact plate being connected with the fifth side of the restriction unit.

7. The switch wire connection device as claimed in claim 4, wherein the second end of the contact plate of the electrical contact is bent toward the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

8. The switch wire connection device as claimed in claim 4, wherein the wire sockets are formed on lower end sections of two sides of the case, two side by side conductive wires being allowed to respectively plug through the wire sockets into the first and second spaces of the restriction unit, whereby the first and second leg sections of the metal leaf spring respectively presses the side by side conductive wires against the first and second finger sections of the contact plate, the plug-in angle of the side by side conductive wires being respectively equal to the inclination angle of the first and second finger sections of the contact plate, an operation hole being formed at a lower end of the case in communication with the cavity and the first and second spaces of the restriction unit.

9. The switch wire connection device as claimed in claim 4, wherein the metal leaf spring is in the form of a V-shaped body having an opening, the metal leaf spring including a bent section connected between the first and second sections, the first section having a head end and an assembling section assembled on an assembling section of the third side of the restriction unit, whereby the first section of the metal leaf spring is positioned in the restriction unit, the head end of the first section of the metal leaf spring and an upper end section of the third side of the restriction unit being together fixed in a recess of the cavity of the case, the bent section of the metal leaf spring being wound on a stake in the cavity of the case, whereby the opening of the metal leaf spring is directed to the conductive component and the second section of the metal leaf spring extends into the restriction unit and can swing within the restriction unit.

10. The switch wire connection device as claimed in claim 9, wherein the second end of the contact plate of the electrical contact is bent toward the opening of the metal leaf spring and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

11. The switch wire connection device as claimed in claim 4, wherein the first side of the restriction unit is bent toward the third side and extends to form a first subsidiary side and the fifth side of the restriction unit is bent toward the third side and extends to form a second subsidiary side.

12. The switch wire connection device as claimed in claim 11, wherein the first and second subsidiary sides are side by side arranged in parallel to each other, at least the second side and the first subsidiary side serving to help in restricting the moving path of the first leg section of the metal leaf spring and the fourth side and the second subsidiary side serving to help in restricting the moving path of the second leg section of the metal leaf spring.

13. The switch wire connection device as claimed in claim 11, wherein the first end of the contact plate has a first finger section and a second finger section, the first and second finger sections being respectively connected with the first and fifth sides of the restriction unit, the second end of the contact plate being an inclined and lifted structure and extending in a direction to contact the conductive component.

14. The switch wire connection device as claimed in claim 11, wherein the restriction unit and the contact plate are formed as an integrated structure, the first finger section of the first end of the contact plate being integrally connected with the first side of the restriction unit, the second finger section of the first end of the contact plate being connected with the fifth side of the restriction unit.

15. The switch wire connection device as claimed in claim 11, wherein the second end of the contact plate of the electrical contact is bent toward the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

16. The switch wire connection device as claimed in claim 11, wherein the wire sockets are formed on lower end sections of two sides of the case, two side by side conductive wires being allowed to respectively plug through the wire sockets into the first and second spaces of the restriction unit, whereby the first and second leg sections of the metal leaf spring respectively presses the side by side conductive wires against the first end of the contact plate, the plug-in angle of the conductive wires being equal to the inclination angle of the first end of the contact plate, an operation hole being formed at a lower end of the case in communication with the cavity and the first and second spaces of the restriction unit.

17. The switch wire connection device as claimed in claim 11, wherein the metal leaf spring is in the form of a V-shaped body having an opening, the metal leaf spring including a bent section connected between the first and second sections, the first section having a head end and an assembling section assembled on an assembling section of the third side of the restriction unit, whereby the first section of the metal leaf spring is positioned in the restriction unit, the head end of the first section of the metal leaf spring and an upper end section of the third side of the restriction unit being together fixed in a recess of the cavity of the case, the bent section of the metal leaf spring being wound on a stake in the cavity of the case, whereby the opening of the metal leaf spring is directed to the conductive component and the second section of the metal leaf spring extends into the restriction unit and can swing within the restriction unit.

18. The switch wire connection device as claimed in claim 17, wherein the second end of the contact plate of the electrical contact is bent toward the opening of the metal leaf spring and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

19. The switch wire connection device as claimed in claim 11, wherein a gap is formed between the first and second subsidiary sides.

20. The switch wire connection device as claimed in claim 19, wherein the first subsidiary side is formed with a first raised section directed to the second subsidiary side.

21. The switch wire connection device as claimed in claim 20, wherein the first end of the contact plate has a first finger section and a second finger section, the first and second finger sections being respectively connected with the first and fifth sides of the restriction unit, the second end of the contact plate being an inclined and lifted structure and extending in a direction to contact the conductive component.

22. The switch wire connection device as claimed in claim 21, wherein the metal leaf spring is in the form of a V-shaped body having an opening, the metal leaf spring including a bent section connected between the first and second sections, the first section having a head end and an assembling section assembled on an assembling section of the third side of the restriction unit, whereby the first section of the metal leaf spring is positioned in the restriction unit, the head end of the first section of the metal leaf spring and an upper end section of the third side of the restriction unit being together fixed in a recess of the cavity of the case, the bent section of the metal leaf spring being wound on a stake in the cavity of the case, whereby the opening of the metal leaf spring is directed to the conductive component and the second section of the metal leaf spring extends into the restriction unit and can swing within the restriction unit.

23. The switch wire connection device as claimed in claim 22, wherein the assembling section of the first section of the metal leaf spring is a perforation and the assembling section of the third side of the restriction unit is a raised section, two electrical contacts being disposed in the cavity of the case, the second and fourth sides of the restriction unit being formed with notches for leaning on a shoulder section formed in the cavity of the case.

24. The switch wire connection device as claimed in claim 23, wherein the restriction unit and the contact plate are formed as an integrated structure, the first finger section of the first end of the contact plate being integrally connected with the first side of the restriction unit, the second finger section of the first end of the contact plate being connected with the fifth side of the restriction unit.

25. The switch wire connection device as claimed in claim 24, wherein the second end of the contact plate of the electrical contact is bent toward the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

26. The switch wire connection device as claimed in claim 25, wherein the wire sockets are formed on lower end sections of two sides of the case, two side by side conductive wires being allowed to respectively plug through the wire sockets into the first and second spaces of the restriction unit, whereby the first and second leg sections of the metal leaf spring respectively presses the side by side conductive wires against the first end of the contact plate, the plug-in angle of the conductive wires being equal to the inclination angle of the first end of the contact plate, an operation hole being formed at a lower end of the case in communication with the cavity and the first and second spaces of the restriction unit.

27. The switch wire connection device as claimed in claim 24, wherein the second end of the contact plate of the electrical contact is bent toward the opening of the metal leaf spring and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

28. The switch wire connection device as claimed in claim 27, wherein the wire sockets are formed on lower end sections of two sides of the case, two side by side conductive wires being allowed to respectively plug through the wire sockets into the first and second spaces of the restriction unit, whereby the first and second leg sections of the metal leaf spring respectively presses the side by side conductive wires against the first end of the contact plate, the plug-in angle of the conductive wires being equal to the inclination angle of the first end of the contact plate, an operation hole being formed at a lower end of the case in communication with the cavity and the first and second spaces of the restriction unit.

29. The switch wire connection device as claimed in claim 19, wherein the first end of the contact plate has a first finger section and a second finger section, the first and second finger sections being respectively connected with the first and fifth sides of the restriction unit, the second end of the contact plate being an inclined and lifted structure and extending in a direction to contact the conductive component.

30. The switch wire connection device as claimed in claim 29, wherein the metal leaf spring is in the form of a V-shaped body having an opening, the metal leaf spring including a bent section connected between the first and second sections, the first section having a head end and an assembling section assembled on an assembling section of the third side of the restriction unit, whereby the first section of the metal leaf spring is positioned in the restriction unit, the head end of the first section of the metal leaf spring and an upper end section of the third side of the restriction unit being together fixed in a recess of the cavity of the case, the bent section of the metal leaf spring being wound on a stake in the cavity of the case, whereby the opening of the metal leaf spring is directed to the conductive component and the second section of the metal leaf spring extends into the restriction unit and can swing within the restriction unit.

31. The switch wire connection device as claimed in claim 30, wherein the assembling section of the first section of the metal leaf spring is a perforation and the assembling section of the third side of the restriction unit is a raised section, two electrical contacts being disposed in the cavity of the case, the second and fourth sides of the restriction unit being formed with notches for leaning on a shoulder section formed in the cavity of the case.

32. The switch wire connection device as claimed in claim 31, wherein the restriction unit and the contact plate are formed as an integrated structure, the first finger section of the first end of the contact plate being integrally connected with the first side of the restriction unit, the second finger section of the first end of the contact plate being connected with the fifth side of the restriction unit.

33. The switch wire connection device as claimed in claim 32, wherein the second end of the contact plate of the electrical contact is bent toward the restriction unit and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

34. The switch wire connection device as claimed in claim 33, wherein the wire sockets are formed on lower end sections of two sides of the case, two side by side conductive wires being allowed to respectively plug through the wire sockets into the first and second spaces of the restriction unit, whereby the first and second leg sections of the metal leaf spring respectively presses the side by side conductive wires against the first end of the contact plate, the plug-in angle of the conductive wires being equal to the inclination angle of the first end of the contact plate, an operation hole being formed at a lower end of the case in communication with the cavity and the first and second spaces of the restriction unit.

35. The switch wire connection device as claimed in claim 32, wherein the second end of the contact plate of the electrical contact is bent toward the opening of the metal leaf spring and extends to form a subsidiary end, the second end and the subsidiary end containing an acute angle, a right angle or an obtuse angle, the subsidiary end being further bent toward the conductive component and extends to form a tail end, the subsidiary end and the tail end containing an acute angle, a right angle or an obtuse angle, the switch pushbutton being operable to drive the conductive component into electrical contact with the tail end of the second end of the contact plate to power on or separation from the tail end of the second end of the contact plate to power off.

36. The switch wire connection device as claimed in claim 35, wherein the wire sockets are formed on lower end sections of two sides of the case, two side by side conductive wires being allowed to respectively plug through the wire sockets into the first and second spaces of the restriction unit, whereby the first and second leg sections of the metal leaf spring respectively presses the side by side conductive wires against the first end of the contact plate, the plug-in angle of the conductive wires being equal to the inclination angle of the first end of the contact plate, an operation hole being formed at a lower end of the case in communication with the cavity and the first and second spaces of the restriction unit.

* * * * *